US007448445B2

(12) United States Patent
Doane et al.

(10) Patent No.: US 7,448,445 B2
(45) Date of Patent: Nov. 11, 2008

(54) DOWNHOLE TOOLS HAVING A SEAL RING WITH REINFORCING ELEMENT

(75) Inventors: James C. Doane, Friendswood, TX (US); Sean L. Gaudette, Katy, TX (US); Jason J. Barnard, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 120 days.

(21) Appl. No.: 11/546,703

(22) Filed: Oct. 12, 2006

(65) Prior Publication Data

US 2008/0087417 A1 Apr. 17, 2008

(51) Int. Cl.
*E21B 33/128* (2006.01)

(52) U.S. Cl. ..... 166/196; 166/180; 166/138; 277/341

(58) Field of Classification Search ..... 166/387, 166/196, 180, 138, 217; 277/338–341
See application file for complete search history.

(56) References Cited

U.S. PATENT DOCUMENTS

| | | | | | |
|---|---|---|---|---|---|
| 927,874 | A * | 7/1909 | Robinson | 277/341 |
| 2,069,212 | A * | 2/1937 | Buffington | 277/439 |
| 2,196,668 | A * | 4/1940 | Ragan | 166/122 |
| 2,464,713 | A * | 3/1949 | Penick | 166/138 |
| 2,720,267 | A * | 10/1955 | Brown | 166/119 |
| 2,880,806 | A * | 4/1959 | Davis | 166/138 |
| 3,268,275 | A * | 8/1966 | Laghlin | 175/325.2 |
| 3,436,084 | A * | 4/1969 | Courter | 277/338 |
| 4,441,551 | A | 4/1984 | Biffle | |
| 4,452,463 | A * | 6/1984 | Buckner | 277/338 |
| 4,469,172 | A * | 9/1984 | Clark | 166/115 |
| 4,573,537 | A * | 3/1986 | Hirasuna et al. | 166/387 |
| 4,900,067 | A | 2/1990 | Jansen et al. | |
| 6,142,227 | A * | 11/2000 | Hiorth et al. | 166/123 |
| 6,203,020 | B1 * | 3/2001 | Mireles et al. | 277/339 |
| 6,712,153 | B2 * | 3/2004 | Turley et al. | 166/387 |
| 6,769,491 | B2 * | 8/2004 | Zimmerman et al. | 166/387 |
| 6,843,480 | B2 * | 1/2005 | Nelson et al. | 277/338 |
| 7,165,622 | B2 * | 1/2007 | Hirth et al. | 166/387 |

(Continued)

FOREIGN PATENT DOCUMENTS

GB 2 406 593 A 4/2005

OTHER PUBLICATIONS

Product Report, ZXP Compression Set Liner Packer, Sep. 2001, Baker Hughes Incorporated, Houston, Texas, USA.

(Continued)

*Primary Examiner*—Shane Bomar
(74) *Attorney, Agent, or Firm*—Greenberg Traurig LLP; Anthony F. Matheny

(57) ABSTRACT

A downhole well tool comprises a seal ring secured along the outer surface of the downhole tool. The downhole tool expands the seal ring radially outward into sealing engagement with an outer tubular member in the well. The seal ring has an annular reinforcing element having an outer wall surface, an inner wall surface, and at least one hole disposed between the outer wall surface and the inner wall surface. At least one sealing material, either preformed or molded in place with the reinforcing element, is disposed along the outer wall surface, through each of the holes, and along at least a portion of the inner wall surface.

21 Claims, 3 Drawing Sheets

U.S. PATENT DOCUMENTS

2003/0080515 A1 5/2003 Milberger et al.

OTHER PUBLICATIONS

Notification of Transmittal of the International Search Report and the Written Opinion of the International Searching Authority, Or the Declaration, Mar. 7, 2008, pp. 1-2, PCT/US2007/080809, European Patent Office.
International Search Report, Mar. 7, 2008, pp. 1-3, PCT/US2007/080809, European Patent Office.
Written Opinion of the International Searching Authority, Mar. 7, 2008, pp. 1-6, PCT/US2007/080809, European Patent Office.

* cited by examiner

DOWNHOLE TOOLS HAVING A SEAL RING WITH REINFORCING ELEMENT

BACKGROUND

1. Field of Invention

The invention is directed to downhole tools having a sealing material disposed on an outer wall surface of the downhole tools and methods for securing a sealing material to the outer wall surface of the downhole tools.

2. Description of Art

Resilient sealing rings are widely used on the outer surfaces of downhole tools such as packers, space-out assemblies, anchors, and excluder subs. The sealing ring typically engages an outer tubular member, such as casing, in the well. The ring may be used to provide a seal or to provide a frictional surface on the outer surface of the tool to assist in positioning the tool within a bore of a well. The sealing material of the ring may also be used to provide a more flexible or expandable connection between two components of a downhole tool.

It is desired to secure the sealing material to the downhole tool such that the sealing material stays secured to the downhole tool. In some downhole tools, previously, the resilient material was secured to an outer diameter surface of a metal reinforcing ring of the downhole tool. When set, the reinforcing ring is expanded plastically beyond the yield strength of the metal of the reinforcing ring. The prior art tools used chemical bonding to secure the sealing material to the reinforcing ring. These chemical compounds, however, become less effective as the temperature increases, especially where the temperature increases above 400° F. As a result, the bond of the resilient material to the outer surface of the reinforcing ring is compromised and the resilient material is released from the outer surface of the reinforcing ring. Accordingly, the tool becomes inoperable or ineffective.

Additionally, fluids within the well that flow around and past the downhole tools, either flowing up the well or down the well, slowly undermine the chemical compound securing the sealing material to the outer surface of the metal reinforcing ring of the downhole tools. The flowing fluids may dissolve or otherwise prevent the chemical compound from maintaining its bonding capabilities. Further, the flowing fluids may force themselves, together with debris carried in the flowing fluids, between the interface of the sealing material with the metal surface of the reinforcing ring. Therefore, the flowing fluid, either alone or in combination with elevated temperatures within the well, can cause the bond of the sealing material to the metal surface of the reinforcing ring to weaken, thereby causing the seal to leak and, thus, rendering the tool inoperable or ineffective. As a result, costs are increased for replacing and repairing, if possible, the damaged downhole tool having an insufficiently secured sealing material to metal wall surface of the reinforcing ring.

Accordingly, prior to the development of the present invention, there have been no downhole tools having a sealing material secured to the metal outer wall surface of a radially expansible reinforcing ring that: increase the life of the downhole tool by increasing the length of time the sealing material remains bonded to the reinforcing ring and, thus, decrease the costs associated with replacing and repairing the downhole tools; and provide more effective bonding of the sealing material at elevated temperatures. Therefore, the art has sought downhole tools having a resilient material secured to an outer wall surface of a radially expansible metal ring that: increase the life of the downhole tool by increasing the length of time the sealing material remains bonded to the reinforcing ring and, thus, decrease the costs associated with replacing and repairing the downhole tools; and provide more effective bonding of the sealing material at elevated temperatures.

SUMMARY OF INVENTION

Broadly, the downhole tools disclosed herein include a sealing material being secured to a metal reinforcing element of a downhole tool through one or more holes in the reinforcing element so that the sealing material is located on the outer wall surface of the reinforcing element, e.g., the outer diameter of the downhole tool, and along an inner wall surface of the reinforcing element opposite the outer wall surface, and in communication with the outer wall surface through one or more holes in the reinforcing element. In one specific embodiment, the sealing material is a high temperature elastomer or polymer.

The sealing material may be secured to the outer wall surface and the inner wall surface of the reinforcing element of the downhole tool by molding the material simultaneously to the outer wall surface and the inner wall surface. In another specific embodiment, the sealing material may be secured to the outer wall surface and the inner wall surface of the downhole tool by placing preformed sealing material along the outer wall surface and the inner wall surface such that the preformed sealing material along the outer wall surface contacts the sealing material along the inner wall surface through each of the holes. Heat, ultraviolet light, or any other mechanism capable of fusing the two pieces of preformed sealing material together, such as by melting or cross-linking the two preformed sealing material pieces, is then used to secure the two sealing material pieces to the downhole tool.

In one aspect, one or more of the foregoing advantages have been achieved through a downhole tool having an annular seal ring and a cam surface for radially expanding the seal ring from a run-in position to a set position in engagement with an outer tubular member. The seal ring comprises a reinforcing element having an annular wall with an outer wall surface and an inner wall surface, and at least one hole extending through the annular wall, the reinforcing element being radially enlarged when the seal ring expands from the run-in position to the set position; and a sealing material disposed around the outer wall surface of the reinforcing element for engagement with the outer tubular member, through the hole of the reinforcing element, and around at least a portion of the inner wall surface of the reinforcing element.

An additional feature of the downhole tool is that the sealing material is disposed around at least a portion of the inner wall surface of the reinforcing element for engagement with the cam surface. A further feature of the downhole tool is that the sealing material may be molded in place with the reinforcing element. Another feature of the downhole tool is that the sealing material may be disposed along substantially the entirety of the inner wall surface. An additional feature of the downhole tool is that the reinforcing member may have a circular rim at one end of the annular wall that forms a metal-to-metal seal with the cam surface when the seal ring is in the set position. Still another feature of the downhole tool is that the sealing material may comprise an outer annular member and an inner annular member, the annular members being in contact with each other at the hole. A further feature of the downhole tool is that at least one of the annular members may have a protuberance that extends into the hole and is bonded to the other of the annular members. Another feature of the downhole tool is that the sealing material may be chemically bonded to the inner wall surface and/or to the outer wall surface.

In another aspect, one or more of the foregoing advantages also may be achieved through a downhole tool for a well. The downhole tool comprises a body having a longitudinal axis; a cam member carried by the body and having a conical surface portion; and a seal ring carried by the body in engagement with the conical surface portion of the cam member, the seal ring having a metal reinforcement member with an annular wall and a circular rim on at least one end of the annular wall, the annular wall having an inner wall surface, an outer wall surface, and a plurality of holes extending between the inner and outer wall surfaces, and the annular wall being encased in a sealing material that is disposed along the outer wall surface, through the holes, and along the inner wall surface, wherein relative axial movement between the seal ring and the cam member causes the reinforcing member and the sealing material to radially expand to a set position for contacting the sealing material with an outer tubular member in the well, and while in the set position, the sealing material contacts the conical surface portion of the cam member, and the rim of the reinforcing element contacts the conical surface portion of the cam member in metal-to-metal contact.

A further feature of the downhole tool is that the downhole tool may further comprise an additional circular rim on a second one of the ends of the reinforcing element, the additional circular rim engaging the conical surface portion of the cam member in metal-to-metal contact when the seal ring is in the set position. Another feature of the downhole tool is that at least a portion of the annular wall of the reinforcing element may be generally conical. An additional feature of the downhole tool is that the sealing material may comprise a preformed outer annular member positioned in contact with the outer wall surface of the reinforcing element and a preformed inner annular member positioned in contact with the inner wall surface of the reinforcing element, at least one of the annular members having protrusions that extend into the holes of the reinforcing element, the protrusions being bonded to the other of the annular members. Still another feature of the downhole tool is that the sealing material may be selected to be operable in a temperature range in excess of 400 degrees F. A further feature of the downhole tool is that the durometer hardness of the sealing material may be in the range from about 60 to 100 Shore A. Another feature of the downhole tool is that the sealing material may have a cylindrical exterior surface and a conical interior surface. An additional feature of the downhole tool is that the sealing material may be chemically bonded to the inner wall surface and/or the outer wall surface of the reinforcing member. Still another feature of the downhole tool is that an amount of radial expansion of the reinforcing element to the set position may exceed a yield strength of the reinforcing element.

In another aspect, one or more of the foregoing advantages may be achieved through a downhole tool having a seal ring for sealing against an outer tubular member in a well, the tool having a cam surface for radially expanding the seal ring from a run-in position to a set position. The seal ring comprises a metal reinforcing element having an annular wall with an outer wall surface and an inner wall surface, and a plurality of holes extending through the annular wall; circular, metal upper and lower rims on the reinforcing element at upper and lower ends of the annular wall; and a sealing material molded around the annular wall and within the holes of the reinforcing element for sealing against the outer tubular member in the well, wherein, in the set position, the upper and lower rims are in metal-to-metal sealing engagement with the conical surface of the cam surface, and an inner surface of sealing material is in sealing engagement with the conical surface of the cam surface.

A further feature of the downhole tool is that the reinforcing member may expand radially an amount in excess of a yield strength of the metal of the reinforcing member when the seal ring is moved from the run-in to the set position. Another feature of the downhole tool is that the sealing material may be of a type selected to withstand temperatures in the well in excess of 400 degrees F. An additional feature of the downhole tool is that the durometer hardness of the sealing material may be in a range from about 85 to 95 Shore A.

The foregoing downhole tools having a resilient material secured to an outer wall surface of a radially expansible metal ring have the advantages of: increasing the life of the downhole tool and, thus, decreasing the costs associated with replacing and repairing the downhole tools; and providing more effective bonding of the resilient material at elevated temperatures.

Figure 1:
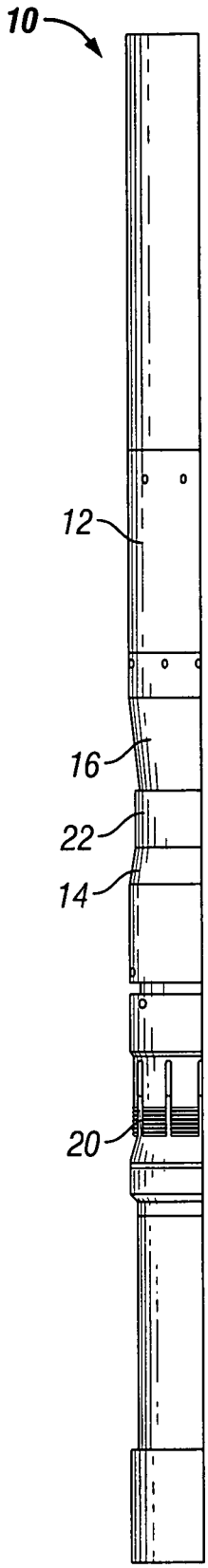
FIG. 1 is a partial cross-sectional view of a packer showing a seal ring disposed on the outer surface of the downhole tool.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-6, a downhole tool, such as a packer 10, includes a body or housing 12 and a sealing member or seal 22 disposed on the outer surface of housing 12 for sealing against a surrounding well casing. Housing 12 is generally cylindrical but may be any shape desired or necessary to form the downhole tool. An actuating member 14 is mounted to housing 12 for axial movement relative to housing 12. In this example, actuating member 14 engages a lower end of seal ring 22 for pushing seal ring 22 upward on a stationary cam surface 16 of housing 12 to cause seal ring 22 to expand radially into the set position. Cam surface 16 is preferably conical. Actuating member 14 may be an annular collet that is radially expansible, or it could be other configurations. In this embodiment, actuating member 14 is secured to a piston (not shown) supplied with hydraulic pressure for moving seal ring 22 relative to cam surface 16.

Tool 10 may be of a conventional design, and actuating member 14 may be moved by a variety of means other than hydraulic pressure, such as employing the weight of the running string (not shown) for tool 10, hydrostatic wellbore pressure, wireline movement, or explosives. Also, although seal ring 22 is shown moving upward onto stationary cam surface 16, the arrangement could be reversed, with seal ring 22 being moved downward. Further, seal ring 22 could be held axially stationary and cam surface 16 be moved relative to seal ring 22. For example, actuating member 14 may actually be held stationary while the running string and housing 12 move downward relative to seal ring 22, pushing seal ring 22 farther onto conical cam surface 16. Alternately, cam surface 16 may move upward relative to seal 22. Regardless of the arrangement, while being set, seal ring 22 and cam surface 16 move axially relative to each other to deform seal ring 22 radially outward to a larger diameter for engaging an inner wall surface 18 of an outer tubular member 19 (FIGS. 3 and 4) into which tool 10 is lowered. Outer tubular member 19 may be a string of casing. As shown in FIG. 1, tool 10 in this example also has a set of slips 20 that expand outward and frictionally grip inner wall surface 18 of outer tubular member 19 (FIGS. 3 and 4)

Figure 2:
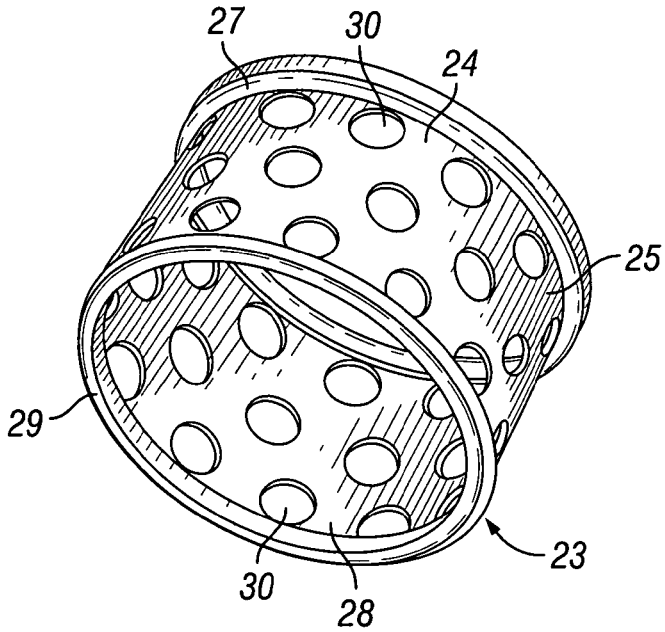
FIG. 2 is a perspective view of a portion of a reinforcing element for the seal ring of FIG. 1, shown without having any sealing material attached.

Referring to FIG. 2, seal ring 22 (FIG. 1) has an internal metal reinforcing element 23. Reinforcing element 23 is an annular member that includes an annular wall 25. Annular wall 25 has an outer wall surface 24 and an inner wall surface 28. A circular upper rim 27 is formed on the upper end of reinforcing element 23, and a circular lower rim 29 is formed on the lower end of reinforcing element 23. In this example, rims 27, 29 differ in diameters, with the inner diameter of lower rim 29 being smaller than the inner diameter of upper rim 27. The difference in diameter is selected so as to match the conical angle of cam surface 16 (FIG. 1). Similarly, annular wall 25 is preferably conical at the same cone angle as cam surface 16. Also, the inner diameter surfaces of upper and lower rims 27, 29 are preferably conical to match the angle of taper of cam surface 16. Preferably reinforcing element 23, including its rims 27, 29 is formed of a carbon steel.

Holes 30 are disposed in reinforcing element 23 between outer wall surface 24 and inner wall surface 28. Thus, outer wall surface 24 is in fluid communication with inner wall surface 28 through holes 30. Holes 30 are shown circular but they could be of any shape.

Figure 3:
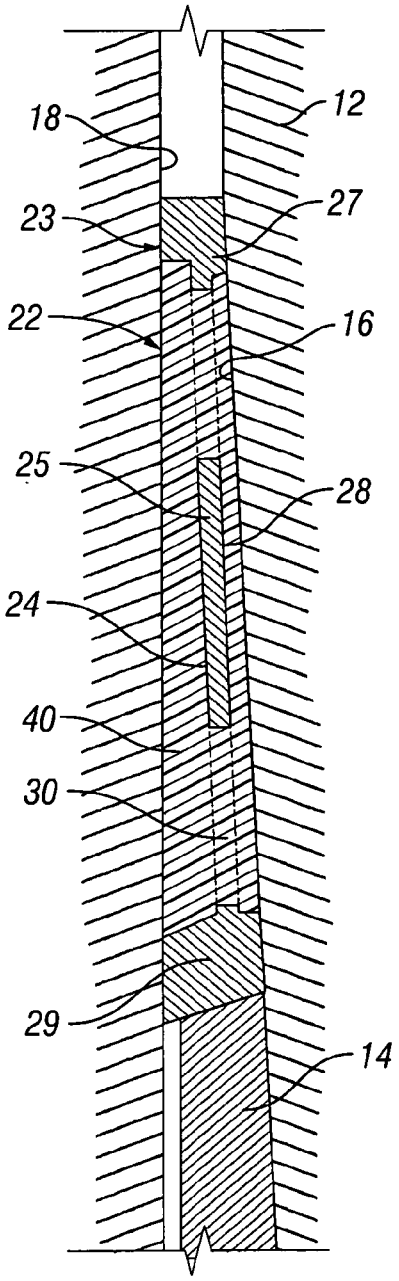
FIG. 3 is an enlarged cross-sectional view of the seal ring illustrated in FIG. 1, shown in a set position.
Figure 4:
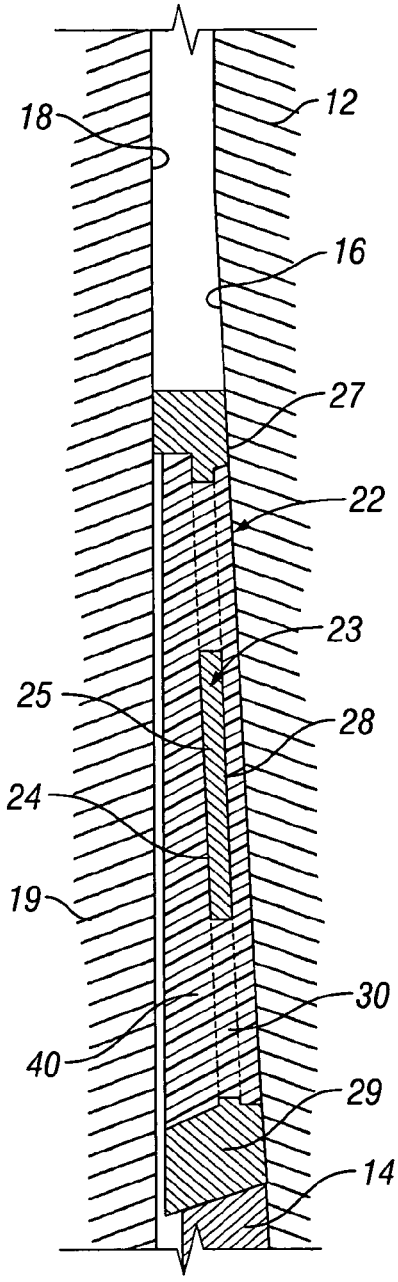
FIG. 4 is an enlarged cross-sectional view of the seal ring of FIG. 3, but shown in a run-in position.
Figure 5:
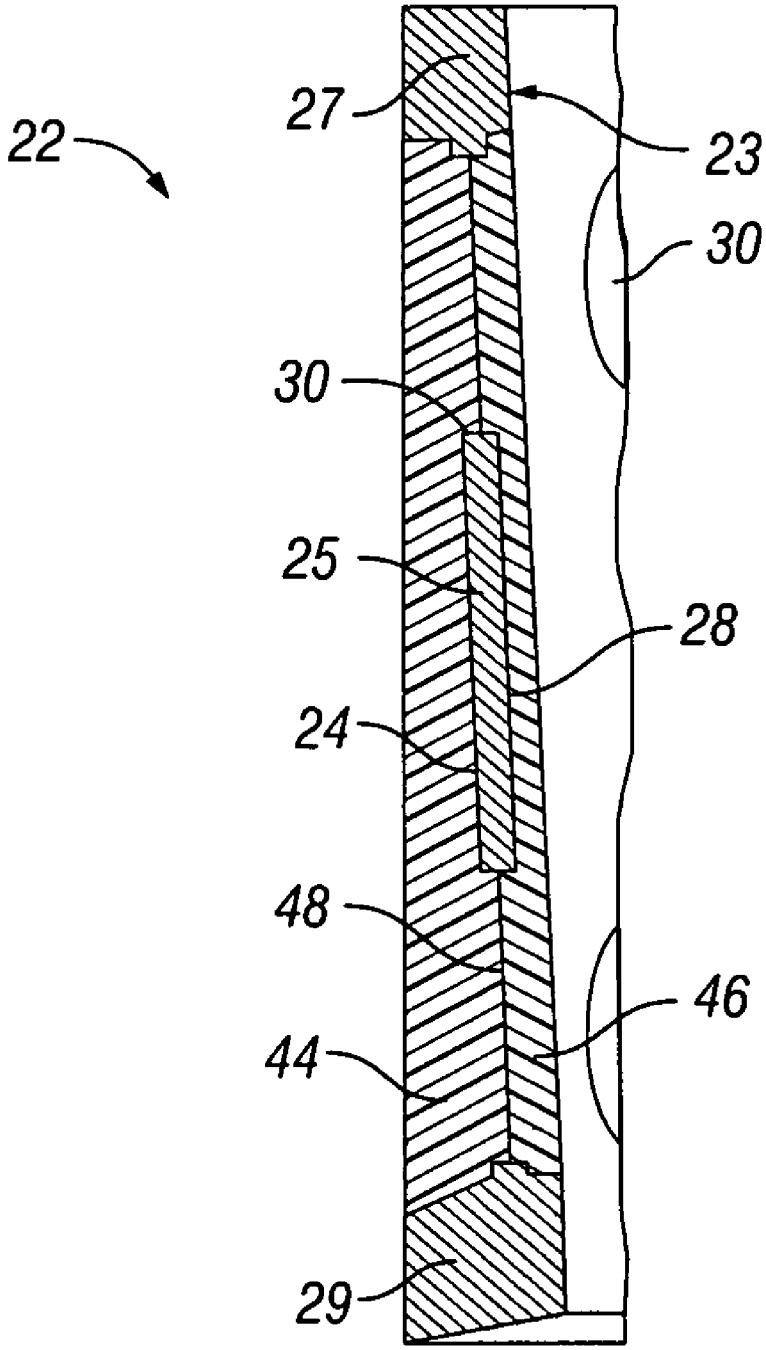
FIG. 5 is a cross-sectional view of an alternate embodiment of the seal ring of FIG. 1

Referring to FIGS. 3 and 4, seal ring 22 includes sealing material 40, which is secured to reinforcing element 23 in accordance with one embodiment. Sealing material 40 is disposed along outer wall surface 24 and inner wall surface 28, with annular wall 25 of reinforcing element 23 embedded within. The upper and lower edges of sealing material 40 preferably terminate at rims 27, 29, leaving rims 27, 29 exposed on both the inner and outer diameters. It is to be understood, however, that rims 27, 29 may be partially or fully covered by sealing material 40 so that rims 27, 29 cannot be exposed or so that rims 27, 29 may subsequently become exposed when seal ring 22 is placed in the set position. The outer diameter of sealing material 40, prior to the set position, is preferably cylindrical for sealing against inner wall surface 18 of outer tubular member 19. The inner diameter of sealing material 40 is preferably conical and at the same angle as cam surface 16. The thickness of sealing material 40 thus decreases in an upward direction. Similarly, the thickness of upper rim 27 is less than lower rim 29 in the embodiment shown in FIGS. 3-4.

Sealing material 40 may be a single piece of sealing material that is molded in place, such as through extrusion methods, to outer wall surface 24 and inner wall surface 28 such that the portions of sealing material 40 on the inner and outer diameters of annular wall 25 is viewed in cross-section as a single piece of sealing material 40 (FIG. 4). During molding, part of the sealing material 40 flows through holes 30. The portions of sealing material 40 on inner wall surface 28 thus are molded to the portions of sealing material 40 on outer wall surface 24 via holes 30.

Because sealing material 40 is located both on the inner and outer diameters and within holes 30 of reinforcing element 23, it may not always be necessary that sealing material 40 be bonded to the metal of reinforcing element 23. However, conventional chemical or adhesive bonding of sealing material 40 with the metal of reinforcing element 23 as a back up is preferred.

Rather than molding sealing material 40 in place with reinforcing element 23, two or more separate pieces of sealing material, e.g., outer wall surface sealing member 44 and inner wall surface sealing member 46, may be molded in advance and disposed along outer wall surface 24 and inner wall surface 28, respectively, such that outer wall surface sealing member 44 contacts inner wall surface sealing member 46 within hole 30. Both inner and outer wall sealing members 44, 46 are preferably annular. In the embodiment shown in FIG. 5, outer wall surface sealing member 44 and inner wall surface sealing member 46 preferably include nubs 48 that are inserted partially into holes 30 to facilitate outer wall surface sealing member 44 contacting inner wall surface sealing member 46. Outer wall surface sealing member 44 is then bonded, adhered, or fused to inner wall surface sealing member 46 at the contacting surfaces of nubs 48. Nubs 48 of members 44, 46 may be fused by means such as through heat, ultraviolet light, radiation, or a chemical agent. As mentioned, preferably, outer wall surface sealing material 44 and inner wall surface sealing material 46 are molded in advance with nubs 48 and fitted to reinforcing element 23. Adhesively bonding sealing members 44, 46 to reinforcing element 23 may also be performed.

Sealing material 40 may be any material known to persons of ordinary skill in the art. In the preferred embodiment, sealing material 40 is a resilient, elastomeric or polymeric material of a commercially available type that will withstand high temperatures that occur in some wells. For example, sealing material 40 may be a perfluoro elastomer. Preferably, the durometer hardness of sealing material 40 is in the range from about 60 to 100 Shore A and more particularly from 85 to 95 Shore A. In one embodiment, the durometer hardness is about 90 Shore A. Other suitable sealing materials 40 include polymers, thermoplastics, Teflon and polyether ether ketone. For lower temperature wells, sealing material 40 could be nitrile rubber or other lower temperature conventional materials.

As mentioned, preferably sealing material 40 is bonded chemically to reinforcing element 23. In one specific embodiment of the methods for bonding, a solvent degreaser is used to eliminate any oil residue on outer wall surface 24 and, preferably, inner wall surface 28. Outer wall surface 24 and inner wall surface 28 are then preferably sandblasted to remove any oxidation from the area of reinforcing element 23 that is being bonded to sealing material 40, create a rough surface for sealing material 40 to adhere to, and expose a brand new layer of reinforcing element 23, by removing the oxidation and, thus, providing a chemically active surface to which a chemical bonding agent or adhesive bond.

After outer wall surface 24 and inner wall surface 28 are prepared, a chemical bonding agent or adhesive is applied to outer wall surface 24 and inner wall surface 28. The chemical bonding agent can be any chemical bonding agent known to persons of ordinary skill in the art. The chemical bonding agent may be water or solvent based, and may require use of a primer coat prior to the chemical bonding agent being applied to outer wall surface 24 and inner wall surface 28. Additionally, the chemical bonding agent may be activated by heat, radiation, ultraviolet light, or by use of another chemical. In one preferred embodiment, the chemical bonding agent is sold under the brand name Chemlok® by Lord Corporation located in Erie, Pa.

After outer wall surface 24 and, preferably inner wall surface 28, are prepared as described above, sealing material 40 is molded along outer wall surface 24 and inner wall surface 28. During the molding process, the chemical bonding agent or adhesive is heated to its activation temperature where it chemically reacts with the performed sealing material 40. The chemical reaction creates the desired bond strength between sealing material 40 and outer wall surface 24 and inner wall surface 28. Preferably, the chemical bonding agent or adhesive is placed on all surfaces that contact sealing material 40.

During operation, seal ring 22 is installed on housing 12 in a run-in position, with its inner diameter partially located on cam surface 16 as illustrated in FIG. 4. Tool 10, such as the packer shown in FIG. 1, is lowered within the well to a desired depth. The outer diameter of seal ring 22 will be spaced inward from the outer tubular member 19, typically casing. Slips 20 (FIG. 1) are moved into gripping contact with inner wall surface 18 of outer tubular member 19, and actuating member 14 is stroked to push seal ring 22 further onto cam surface 16. This movement causes seal ring 22 to expand radially outward into sealing contact with inner wall surface 18 of outer tubular member 19, as shown in FIG. 3.

During the expansion, reinforcing element 23 will expand radially, and the amount of expansion typically will exceed the yield strength of the metal of reinforcing element 23. Consequently, the deformation of reinforcing element 23 is permanent. After expansion, the inner diameters of upper and lower rims 27, 29 may be in metal-to-metal contact with cam surface 16. In one specific embodiment, after expansion, the inner diameters of upper and lower rims 27, 29 are in metal-to-metal sealing contact with cam surface 16. In this embodiment, preferably, the inner diameter portion of sealing material 40 will be in sealing contact with cam surface 16. Preferably, the deformation of seal ring 22 is substantially radial. Preferably, seal ring 22 is capable of expanding at least 10 percent in diameter from the run-in to the set position, although in some cases the amount of expansion that actually occurs is much less.

Additionally, after expansion, the outer diameters of upper and lower rims 27, 29 may be in contact with inner wall surface 18 of outer tubular member 19.

The invention has significant advantages. The sealing material of the seal ring has improved retention with its reinforcing element because it is located on both the inner and outer sides of the reinforcing element and integrally connected through the holes in the wall. The sealing material is less likely to delaminate from its reinforcing element at high temperatures.

It is to be understood that the invention is not limited to the exact details of construction, operation, exact materials, or embodiments shown and described, as modifications and equivalents will be apparent to one skilled in the art. For example, as mentioned, the sealing material may be preformed prior to being secured to the reinforcing element of the seal ring. Alternatively, the sealing material may be extruded onto the reinforcing element of the seal ring, i.e., in place. Moreover, the reinforcing element may include a single hole or a plurality of holes for securing the sealing material to the reinforcing element. Further, chemical bonding agents may be used in combination with the holes in the reinforcing element so that outside forces do not act upon the connection of the sealing material through the holes until the chemical bonding is compromised. Additionally, the sealing material can be a single piece, or a plurality of pieces of rubber or other sealing material. Also, the reinforcing ring may be formed out of a material other than metal. Moreover, the sealing material may be any material known to persons of ordinary skill in the art that is capable of providing a seal between the tool and the inner wall surface of the outer tubular member. Accordingly, the invention is therefore to be limited only by the scope of the appended claims.

What is claimed is:

1. A downhole tool having an annular seal ring and a cam surface for radially expanding the seal ring from a run-in position to a set position in engagement with an outer tubular member, the seal ring comprising:

a reinforcing element having an annular wall with an outer wall surface, an inner wall surface, an upper circular rim at an upper end, a lower circular rim at a lower end, and a plurality of holes extending through the annular wall, the plurality of holes being disposed in at least three parallel rings, a first parallel ring being disposed adjacent the upper circular rim, a second parallel ring being disposed adjacent the lower circular rim, and a third parallel ring being disposed between the first and second parallel rings, and the reinforcing element being radially enlarged when the seal ring expands from the run-in position to the set position; and a sealing material disposed around the outer wall surface of the reinforcing element for engagement with the outer tubular member, through the hole of the reinforcing element, and around at least a portion of the inner wall surface of the reinforcing element.

2. The downhole tool of claim 1, wherein the the third parallel ring is offset at a diagonal angle from the first and second parallel rings.

3. The downhole tool of claim 1, wherein the sealing material is molded in place with the reinforcing element.

4. The downhole tool of claim 1, wherein the sealing material is disposed along substantially the entirety of the inner wall surface.

5. The downhole tool of claim 1, wherein the upper circular rim and lower circular rim of the reinforcing element form a metal-to-metal seal with the cam surface when the seal ring is in the set position.

6. The downhole tool of claim 1, wherein the sealing material comprises an outer annular member and an inner annular member, the annular members being in contact with each other at the hole.

7. The downhole tool of claim 6, wherein at least one of the annular members has a protuberance that extends into the hole and is bonded to the other of the annular members.

8. The downhole tool of claim 1, wherein the sealing material is chemically bonded to the outer wall surface.

9. A downhole tool for a well, comprising:

a body having a longitudinal axis;

a cam member carried by the body and having a conical surface portion; and a seal ring carried by the body in engagement with the conical surface portion of the cam member, the seal ring having a metal reinforcement member with an annular wall, an upper circular rim on one end of the annular wall, and a lower circular rim on another end of the annular wall, the annular wall having an inner wall surface, an outer wall surface, and a plurality of holes extending between the inner and outer wall surfaces, the plurality of holes being disposed in at least three parallel rings, a first parallel ring being disposed adjacent the upper circular rim, a second parallel ring being disposed adjacent the lower circular rim, and a third parallel ring being disposed between the first and second parallel rings, and the annular wall being completely encased in a sealing material having no holes disposed therethrough, the sealing material being disposed along the outer wall surface, through each of the plurality holes, and along the inner wall surface, wherein relative axial movement between the seal ring and the cam member causes the metal reinforcement member and the sealing material to radially expand to a set position for contacting the sealing material with an outer tubular member in the well, and while in the set position, the sealing material contacts the conical surface portion of the cam member, and the rim of the metal reinforcement member contacts the conical surface portion of the cam member in metal-to-metal contact.

10. The downhole tool of claim 9, wherein the upper and lower circular rims are adapted for engaging the conical surface portion of the cam member in metal-to-metal contact when the seal ring is in the set position.

11. The downhole tool of claim 9, wherein at least a portion of the annular wall of the metal reinforcement member is generally conical.

12. The downhole tool according to claim 9, wherein the sealing material comprises a preformed outer annular member positioned in contact with the outer wall surface of the metal reinforcement member and a preformed inner annular member positioned in contact with the inner wall surface of the metal reinforcement member, at least one of the annular members having protrusions that extend into the holes of the metal reinforcement member, the protrusions being bonded to the other of the annular members.

13. The downhole tool of claim 9, wherein the sealing material is selected to be operable in a temperature range in excess of 400 degrees F.

14. The downhole tool of claim 9, wherein the durometer hardness of the sealing material is in the range from about 60 to 100 Shore A.

15. The downhole tool of claim 9, wherein the sealing material has a cylindrical exterior surface and a conical interior surface.

16. The downhole tool of claim 9, wherein the sealing material is chemically bonded to the inner wall surface and the outer wall surface of the reinforcing member.

17. The downhole tool of claim 9, wherein an amount of radial expansion of the metal reinforcement member to the set position exceeds a yield strength of the reinforcing element.

18. A downhole tool having a seal ring for sealing against an outer tubular member in a well, the tool having a cam surface for radially expanding the seal ring from a run-in position to a set position, the seal ring comprising:

a metal reinforcing element having an annular wall with an outer wall surface and an inner wall surface, and a plurality of holes extending through the annular wall, the plurality of holes being disposed in at least three parallel rings, a first parallel ring being disposed adjacent the upper circular rim, a second parallel ring being disposed adjacent the lower circular rim, and a third parallel ring being disposed between the first and second parallel rings;

circular, metal upper and lower rims on the reinforcing element at upper and lower ends of the annular wall;

a sealing material molded around the annular wall and within the holes of the reinforcing element for sealing against the outer tubular member in the well; and wherein in the set position, the upper and lower rims are in metal-to-metal engagement with the conical surface of the cam surface, and an inner surface of sealing material is in sealing engagement with the conical surface of the cam surface.

19. The downhole tool according to claim 18, wherein the metal reinforcing element expands radially an amount in excess of a yield strength of the metal of the reinforcing member when the seal ring is moved from the run-in to the set position.

20. The downhole tool according to claim 18, wherein the sealing material is of a type selected to withstand temperatures in the well in excess of 400 degrees F.

21. The downhole tool according to claim 18, wherein the durometer hardness of the sealing material is in a range from about 85 to 95 Shore A.

* * * * *